US005861795A

United States Patent [19]

Glatz-Reichenbach et al.

[11] Patent Number: 5,861,795

[45] Date of Patent: Jan. 19, 1999

[54] CURRENT-LIMITING RESISTOR HAVING PTC BEHAVIOR

[75] Inventors: Joachim Glatz-Reichenbach, Baden; Felix Greuter, Baden-Rütihof; Gerhard Mauthe, Baden, all of Switzerland; Zdenek Pelánek, Brno, Czech Rep.; Claus Schüler, Widen, Switzerland; Jorgen Skindhoj, Baden, Switzerland; Ralf Strümpler, Gebenstorf, Switzerland

[73] Assignee: ABB Research Ltd., Zurich, Switzerland

[21] Appl. No.: 807,171

[22] Filed: Feb. 27, 1997

[30] Foreign Application Priority Data

Mar. 30, 1996 [DE] Germany ..... 196 12 841.2

[51] Int. Cl.[6] ..... H01C 7/10

[52] U.S. Cl. ..... 338/22 R

[58] Field of Search ..... 338/20, 21, 22 R, 338/225 D, 14, 24

[56] References Cited

U.S. PATENT DOCUMENTS

| | | | |
|---|---|---|---|
| 3,976,854 | 8/1976 | Ishikawa et al. | 219/505 |
| 4,486,737 | 12/1984 | Ott et al. | 338/22 R |
| 5,313,184 | 5/1994 | Greuter et al. | 338/21 |
| 5,379,022 | 1/1995 | Bacon et al. | 338/20 |

FOREIGN PATENT DOCUMENTS

| | | |
|---|---|---|
| 2510322 | 8/1976 | Germany . |
| 4142523A1 | 6/1993 | Germany . |
| 4230848C1 | 12/1993 | Germany . |
| 4221309A1 | 1/1994 | Germany . |

*Primary Examiner*—Teresa J. Walberg
*Assistant Examiner*—Jeffrey Pwu
*Attorney, Agent, or Firm*—Burns, Doane, Swecker & Mathis, L.L.P.

[57] ABSTRACT

The current-limiting resistor has two connection electrodes (1, 2) which are arranged parallel to one another as well as a resistance body (3) which has PTC behavior and with which large-area contact is made by the connection electrodes (1, 2). A varistor (40) is in electrically conductive contact with the resistance body (3). The resistance body (3) contains two contact areas (50, 51) as well as a response point (60) which is connected in parallel with the varistor (40) via the two contact areas (50, 51) and implements a PTC transition above a threshold value of a current flowing through the resistor.

Since the resistance body effects the electrical contact with the varistor (40) in the case of this resistor, no metal connection electrodes are required for the varistor. At the same time, due to the outward displacement of the response point (60) away from the varistor (40), the operational reliability of the resistor is considerably improved.

Effective current limiting in load circuits which are operated at high voltage can be achieved by a series circuit formed by a plurality of varistors (40, 41, . . . ) provided in a resistance body (3) which is designed in the form of a meander or is of some other continuous design.

15 Claims, 5 Drawing Sheets

CURRENT-LIMITING RESISTOR HAVING PTC BEHAVIOR

BACKGROUND OF THE INVENTION

1. Field of the Invention

The invention is based on an electrical resistor according to the preamble of patent claim 1. A resistor of this type identifies and limits short-circuit currents or overcurrents flowing in a load circuit. Only after this does a switch provided in the load circuit interrupt the limited current. The switch can therefore be designed for a small breaking power compared with the short-circuit power.

2. Discussion of Background

A current-limiting resistor of the afore-mentioned type is described, for example, in U.S. Pat. No. 5,313,184 A. Such a resistor contains two connection electrodes between which, connected in parallel with one another, a resistance body having PTC behavior and a varistor are arranged. The resistance body and the varistor make contact with one another via the entire insulation clearance between the two connection electrodes. This avoids local overvoltages in the resistance body and hence impermissibly high local thermal loading of the resistance body.

In order to increase the dielectric strength of this resistor, a plurality of resistors can be connected in series. Such an arrangement is relatively complicated since metal electrodes are arranged both between the individual resistance bodies and between the individual varistors. In the normal operating state of the resistor, the current is conducted through a series circuit of a plurality of resistance bodies having PTC behavior, between each of which bodies a metal electrode is arranged. The contact resistance between a metal electrode and the material of the resistance body is generally relatively high and, in the case of a typical resistor for current limiting tasks, having a total resistance of approximately 50 mΩ, contributes just as much as the material of the resistance body to the total resistance. Furthermore, metal electrodes and the polymers which are usually used as material for the resistance body and are filled with a filler have different electrical conductivities and different thermal expansion coefficients. As a result, mechanical stresses may be produced in the interior of the resistor, which stresses may possibly impair the mechanical and electrical properties of said resistor.

SUMMARY OF THE INVENTION

Accordingly, one object of the invention, as it is specified in patent claim 1, is to provide a novel current-limiting resistor having PTC behavior which can be produced in a simple and cost-effective manner and has both a high rated current-carrying capacity and a wide voltage range as well as high operational reliability.

In the case of the resistor according to the invention, the resistance body having PTC behavior is designed in such a way that it ensures the electrical contact both with the connection electrodes and with the varistor. As a result, metal electrodes serving to make electrical contact with the varistor are dispensed with. At the same time, the resistor according to the invention can be produced in an extremely cost-effective manner and using a method which is particularly suitable for mass production. Specifically, the resistance body holding the varistor and the connection electrodes and usually formed by a polymer which is filled with a filler can be produced extremely inexpensively using a customary plastic processing method, such as by injection molding, for instance. The resistor according to the invention can then be completed in an extremely simple manner by inserting the varistor into the resistance body and applying the connection electrodes to the resistance body. Since the material, embodied as a polymer which is filled with a filler, of the resistance body is particularly well matched to the varistor body, which generally comprises a metal oxide ceramic, it is also possible for a large-area contact metallization layer, which is normally provided for the varistor, to be dispensed with if appropriate. A further advantage is to be seen in the fact that the response point which is connected in parallel with the varistor and implements a PTC transition can be arranged, by a suitable design of the resistance body, at a distance from the varistor at which thermal feedback between the response point, which is heated during the PTC transition, and the varistor need not be concern.

If the resistor according to the invention has more than two varistors connected in series, then metal electrodes between the individual varistors and between body elements, having PTC behavior, of the resistance body, which are connected in series in the same way as the varistors, are dispensed with. The initial resistance of the resistor is therefore very significantly reduced and, correspondingly, the rated current-carrying capacity of the current-limiting resistor according to the invention is considerably improved. A particularly high rated current-carrying capacity is achieved if the resistance body is of integral design. The small contact resistance otherwise present between the individual body elements is then completely omitted. Moreover, the resistor can then be produced in a particularly cost-effective manner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Finally.

DESCRIPTION OF THE PREFERRED EMBODIMENTS

Figure 1:
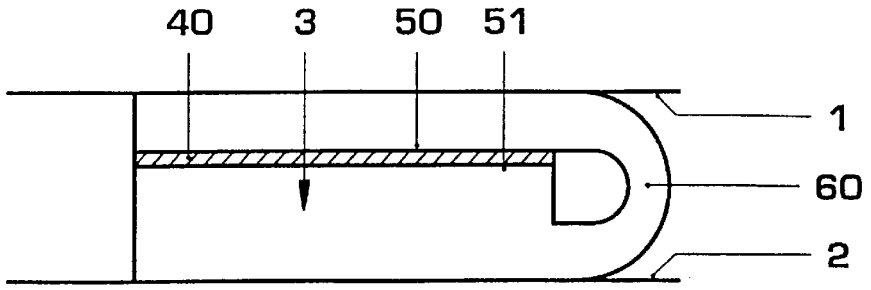
FIGS. 1 to 6, 10 and 11 each show a side view of preferred embodiments of the current-limiting resistor according to the invention, having two connection electrodes which lie parallel to one another, a resistance body having PTC behavior arranged between the connection electrodes, and one or more varistors which make contact with the resistance body.

Referring now to the drawings, wherein like reference numerals designate identical or corresponding parts throughout the several views, the current-limiting resistors illustrated in FIGS. 1 to 6, 10 and 11 each contain a resistance body 3, which is arranged between two metal connection electrodes, 1, 2, aligned parallel to one another, and with which large-area contact is made, as well as a varistor 40 or a plurality of varistors 40, 41, 42, 43, 44, 45.

The varistors 40–45 are preferably formed from a doped ceramic based on a metal oxide, such as ZnO, for instance, or based on a titanate, such as $SrTiO_3$ or $BaTiO_3$, for instance, or based on a carbide, such as SiC, for instance. The varistor 40 provided in the embodiments according to FIGS. 1, 2 and 10 has a breakdown voltage which lies above the rated voltage of the electrical system in which the resistor is employed. In the case of the embodiments according to FIGS. 3, 4, 5, 6 and 11, on the other hand, a plurality of varistors, for example the varistors 40, 41, 42, 43, 44 and 45, are connected in series in a stack arrangement. This varistor stack has a breakdown voltage which likewise lies above the rated voltage of the electrical system containing the current-limiting resistor.

The resistance body 3 comprises a material having PTC behavior and may be formed by a polymer, in particular a thermoplastic or thermosetting polymer, which is filled with an electrically conductive filler such as, for example, high-conductivity carbon black, TiC or $TiB_2$.

The resistors according to the invention can be produced in a simple manner as follows:

Varistors 40 to 45 are first of all produced by a method which is customary in varistor technology, such as, for instance, by pressing or casting and subsequently sintering a ceramic base substance, such as ZnO, for instance, which is doped with various metal oxides. These varistors are designed in the form of a plate and have a thickness of, for example, 2 mm. The varistors may be metal-coated on their planar sides in order to improve the current transfer. A shearing mixer is used to produce PTC material from a thermoplastic polymer, such as a polyethylene, for instance, and an electrically conductive pulverulent filler, such as, for example, TiC. The resistance body 3 is produced from the PTC material by injection molding, for instance. Depending on the design of the resistance body, the varistor 40 is or two or more of the varistors 40 to 45 are incorporated into the resistance body 3. The connection electrodes 1, 2 are then applied to the resistance body and fixed with the exertion of contact pressure. Since the resistance body 3 is produced from compressible material and is at the same time designed to be elastically flexible in the pressure direction, the contact pressure also simultaneously fixes the varistor or the varistors in the resistance body 3.

In all of the embodiments, the resistance body 3 has two contact areas 50, 51 as well as a response point 60, which is connected in parallel with the varistor 40 via the two contact areas 50, 51. The response point 60 is dimensioned in such a way that it implements a PTC transition when a current conducted in the resistor exceeds a predetermined threshold value.

Figure 2:
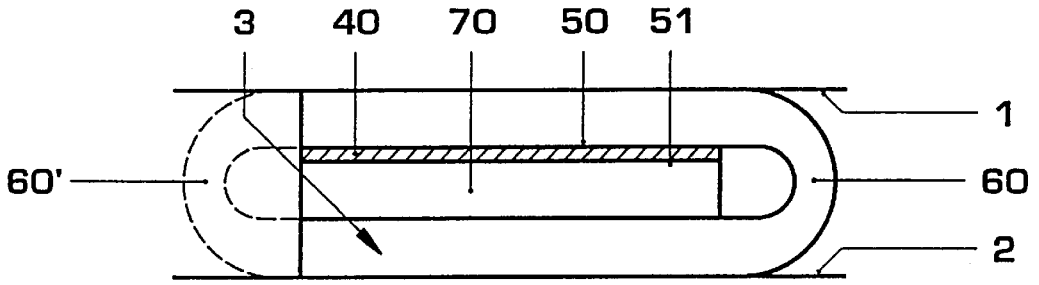

In the embodiments according to FIGS. 1 and 2, the resistance body is essentially of U-shaped design in each case. The contact areas 50 and 51 are respectively arranged on the inner faces of the limb of the U. The effect achieved by this is that the varistor 40 is electrically conductively connected to the connection electrodes 1, 2 via the resistance body 3 without any additional metal contacts. In the embodiment according to FIG. 2, an intermediate piece 70 comprising metal or conductive polymer is additionally provided and is arranged between a contact area of the varistor 40 and the contact area 51 of the resistance body 3. This intermediate piece makes it possible, on the one hand, to widen the U. On the other hand, the intermediate piece 70 serves to absorb thermal energy from the varistor 40. Such energy is produced if a discharge current is conducted through the varistor 40 on account of an overvoltage occurring at the contact areas 50, 51.

In both embodiments, the response point 60 is situated in the bent joining part of the U. As a result of this outward displacement of the response point, the varistor 40 is, on the one hand, protected against thermal heating during a PTC transition and, on the other hand, the build-up of undesirable mechanical stresses in the resistance body 3 during the PTC transition is largely avoided.

The response point may have the same cross-section as the resistance body 3 in the region of the two contact areas 50, 51 since the bend in the U already ensures a local increase in the resistance. In general, however, the response point will be designed as a material shaping which reduces the cross-section of the U in the region of its bend. In every case, the cross-section of the resistance body 3 in the region of the response point 60 should be smaller than each of the two contact areas between the resistance body and the two connection electrodes 1, 2, since only then can the PTC transition be displaced toward the response point 60.

Figure 7:
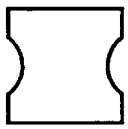
FIGS. 7 to 9 show a side view from the right part of the resistor embodied in accordance with FIGS. 1 and 2, which part is designed as a response point.
Figure 8:
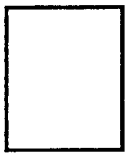
Figure 9:
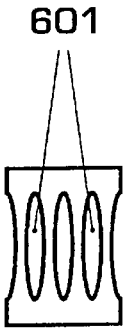

Structural designs of the response point 60 can be seen in FIGS. 7, 8 and 9 and can be achieved by necking the cross-section of the U transversely with respect to the plane of the drawing (FIG. 7) or in the direction of the limbs of the U in the plane of the drawing (FIG. 8 in connection with FIGS. 1 and 2), by arranging slots 601 which are routed in the direction of the ends of the U and run essentially parallel to one another (FIG. 9) or, in a particularly simple manner, by means of round through holes. The slotted embodiment of the response point 60, in particular, is distinguished by the fact that the current is not only conducted in a manner distributed uniformly over the constricted cross-section, but that during the implementation of the PTC transition, the material of the response point can move in practically all directions, as a result of which undesired mechanical stresses in the resistance body 3 are avoided to a particularly great extent.

During rated current operation of the resistor which is incorporated in a load circuit as current limiter, for example, the current fed in via the connection electrode 1 flows via the resistance body 3 designed as a U to the connection electrode 2. If a short-circuit current or an impermissibly high overcurrent occurs in the load circuit, then the particularly high current density at the response point 60 leads to a PTC transition. During the PTC transition, the non-reactive resistance of the resistance body 3 in the region of the response point 60 increases very rapidly by several orders of magnitude, and the current flowing through the resistor is rapidly limited in this way. After the current limiting, overvoltages occurring at the connection electrodes 1, 2 are reduced by means of discharge currents. Since the varistor 40 absorbs energy in this case and is heated to a considerable extent, it is particularly advantageous that the response point 60, which is likewise heated to a great extent by the PTC transition, is arranged such that it is spatially separated from the varistor 40.

In the case of the resistors embodied in accordance with FIGS. 3, 4, 5, 6 and 11, there is additionally provided, as well as the varistor 40, at least one further varistor 41 to 45 connected in series with said varistor. Accordingly, the resistance body 3 has further contact areas, of which only the contact areas 52 and 53 connecting the varistor 41 to potential are designated for reasons of clarity. Further response points, of which only the response point 61 is illustrated for reasons of clarity, are respectively connected in parallel with one, such as e.g. 41, of the further varistors 41 to 45 via two of the further contact areas, such as e.g. 52, 53. In a manner corresponding to the response point 60, these further response points, such as the response point 61, are also shaped into the resistance body 3 in a manner locally decoupled from the varistors and, in a manner corresponding to the response point 60, implement a PTC transition when the current conducted in the resistor exceeds the predetermined threshold value.

Those embodiments of the resistor according to the invention which contain at least two varistors 40, 41 connected in series are provided for use in load circuits having high voltages. When a large current occurs, the response points 60, 61 connected in series implement the PTC transition, and the current flowing through the resistor is rapidly limited in this way. After the current limiting, overvoltages occurring at the connection electrodes 1, 2 are reduced by means of discharge currents which are conducted in the varistors 40, 41 connected in series. If one of the response points, for example the response point 61, responds before the other response points have responded, then the occurrence of impermissibly high overvoltages at this response point is avoided by the varistor connected in parallel.

Figure 3:
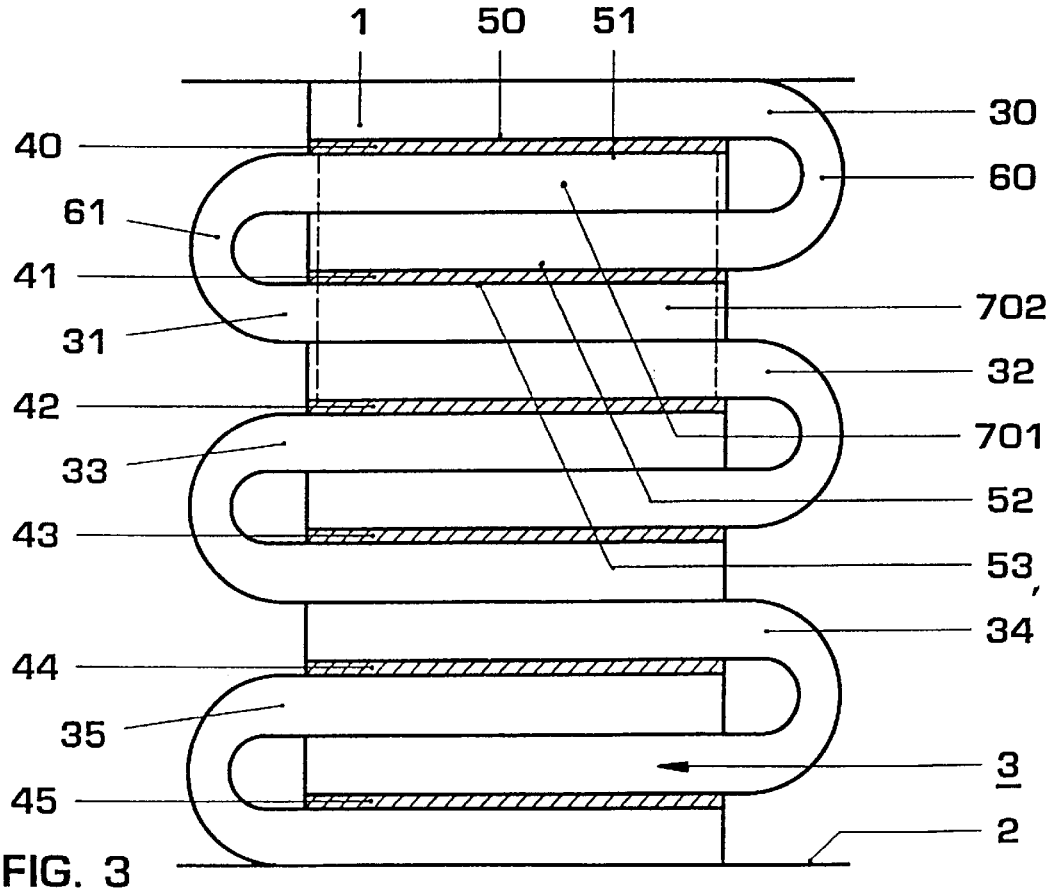
Figure 5:
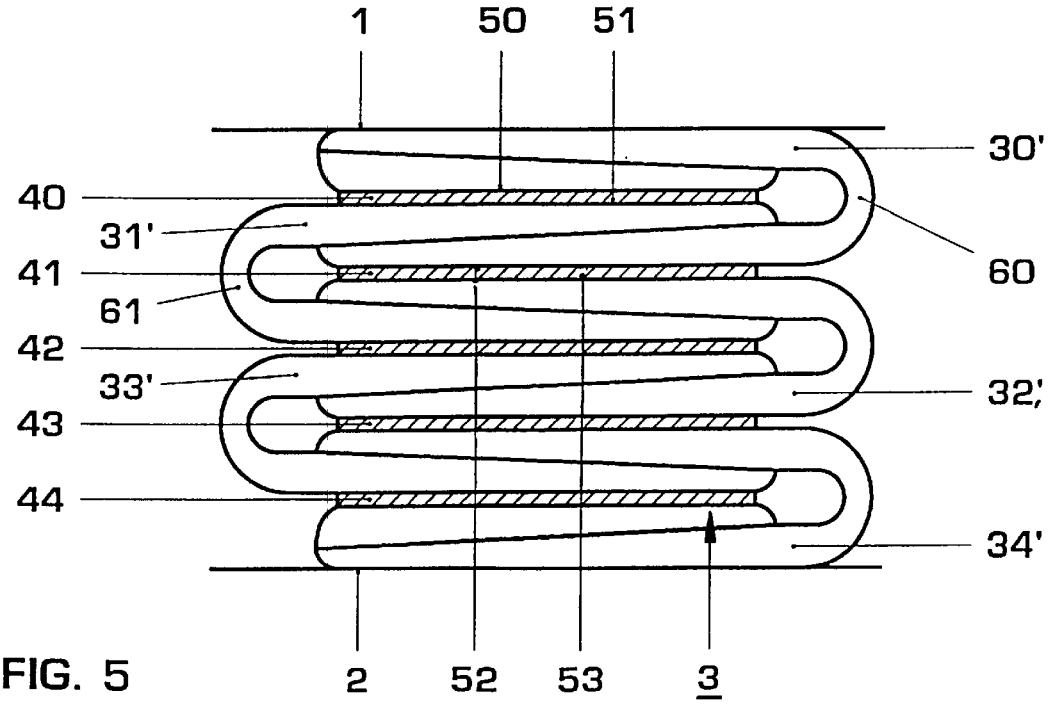
Figure 6:
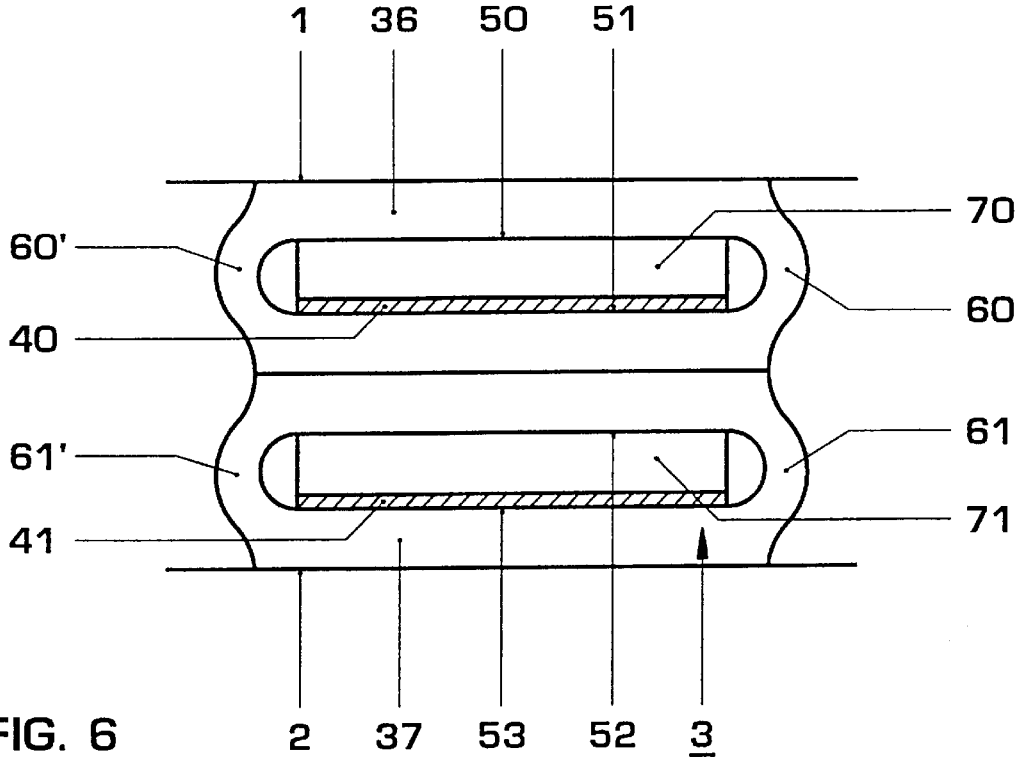

As can be gathered from FIGS. 3 and 5 and 6, the resistance body 3 is constructed from body elements 30 to 35 and 30' to 34' and 36 and 37, respectively, in each case having two sections running parallel to the connection electrodes and at least one part which connects the two sections and contains the response point, for example 60, 61. One of the varistors, for example 41, is respectively arranged between the two sections of the body elements, for example 31, 31' or 36.

In the embodiments according to FIGS. 3 and 5, the body elements 30 to 35 are in each case designed as a U and are joined to one another in such a way that the resistance body 3 forms a meander. In the case of this meander, each two Us which succeed one another in pairs in the meander are rotated through 180° with respect to each other and pushed one into the other in such a way that in each case one of the limbs of one of the Us is situated between the limbs of the other U. The varistors can then make contact with the resistance body 3 without any additional spacer means simply by being pushed into the Us.

Particularly good mechanical strength of the resistance body 3 is obtained if, as is evident from the embodiment according to FIG. 5, in each case one of the varistors, for example 41, and one limb each of two Us which are adjacent in the resistance body and are separated from one another only by the varistor, for example the body elements 30' and 32', are arranged between the two sections of at least one of the Us, for example of the body element 31'. If, in addition, the mutually facing inner faces of the limbs, lying one on the other, of the Us, for example of the body elements 31' and 32' or 30' and 31', are designed such that they are beveled in the shape of a wedge, then it is possible to produce the resistance body 3 in a particularly simple manner by reciprocal wedging of the individual Us. Moreover, the Us produced by injection molding can then be removed without difficulty from the injection mold.

In the embodiments according to FIGS. 3 and 5, the varistors 40 to 45 and 40 to 44, respectively, which succeed one another in the resistance body 3 can additionally be connected by means of intermediate pieces 701, 702 which are bent in a U-shaped manner (for reasons of clarity, two such parts are indicated by dashed lines in FIG. 3 only). As a result of this, on the one hand, a particularly low-impedance series circuit of the varistors is achieved and, on the other hand, the heat generated by the varistors during the occurrence of discharge currents is conducted away from the interior of the resistor.

Figure 4:
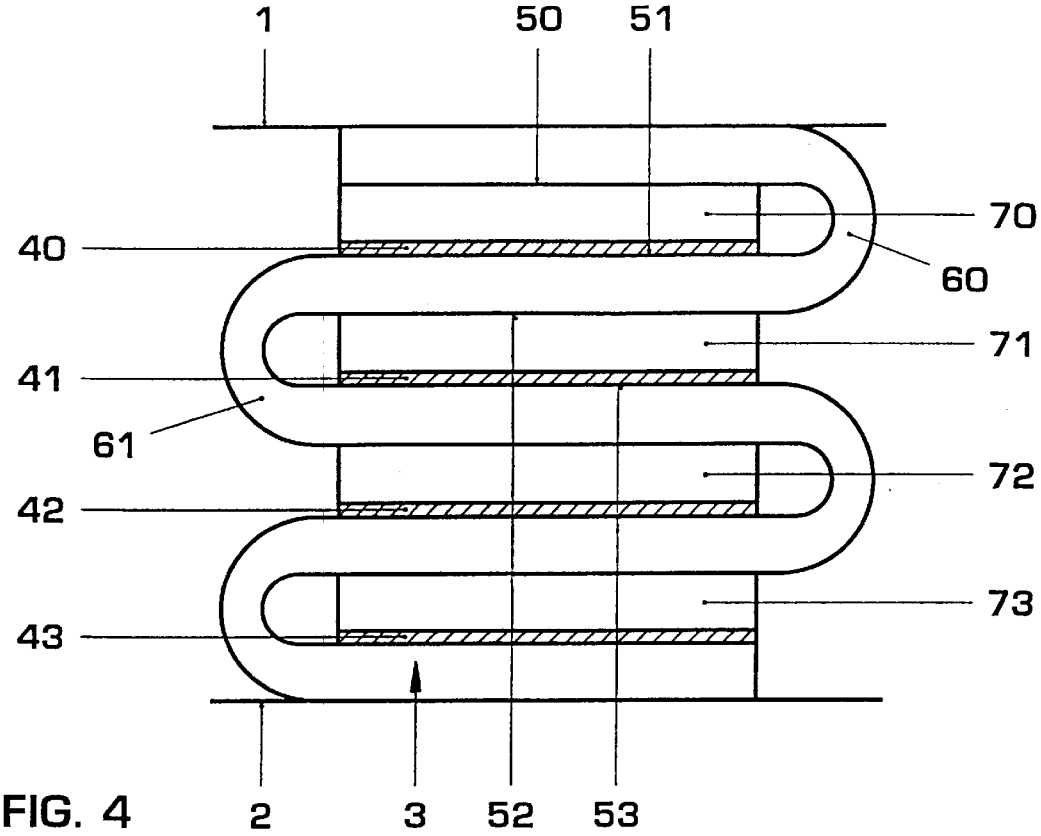
Figure 11:
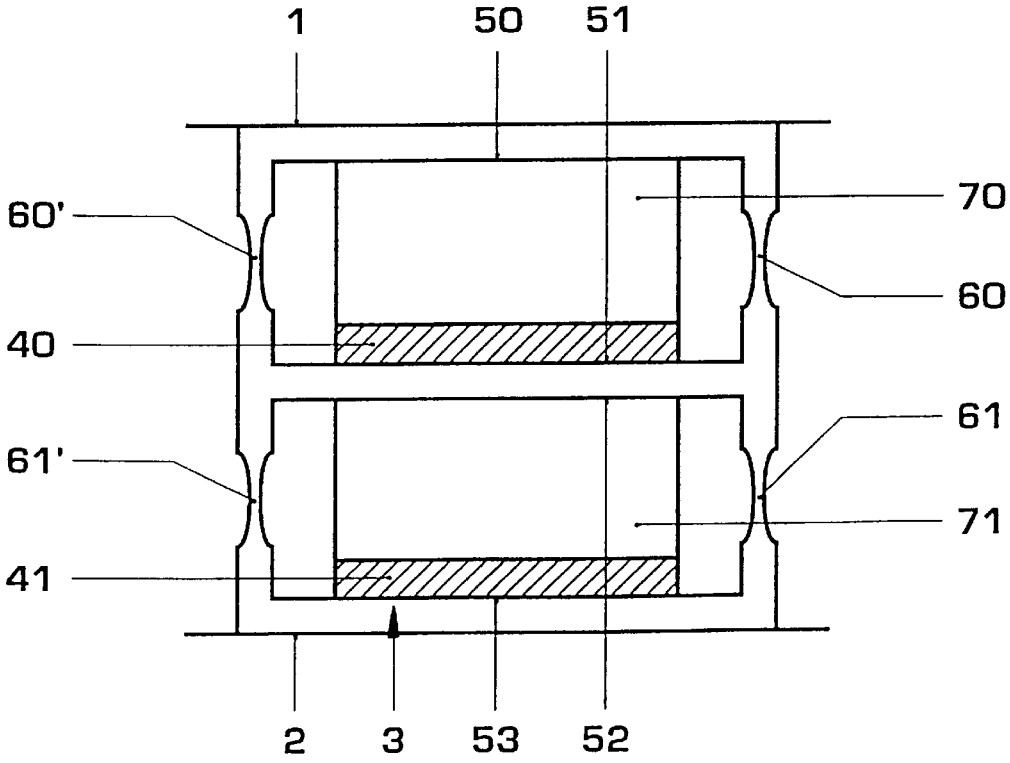

From FIGS. 4 and 11, embodiments of the resistor according to the invention are evident in which the resistance body is of integral design. Since the contact resistance between the individual body elements is omitted in these embodiments, the resistance body 3 is distinguished by a particularly low non-reactive resistance. At the same time, the resistance body can be produced in a molding operation and then the resistor can be produced in a particularly simple and cost-saving manner by subsequent insertion of the varistors and of the optionally provided intermediate pieces 70 to 73 and 70, 71. If the varistors are designed in the form of discs, the resistance body 3 then has pockets of semicircular cross-section which are open to the front and closed to the rear and into which the individual varistors are inserted during the production of the resistor.

Figure 10:
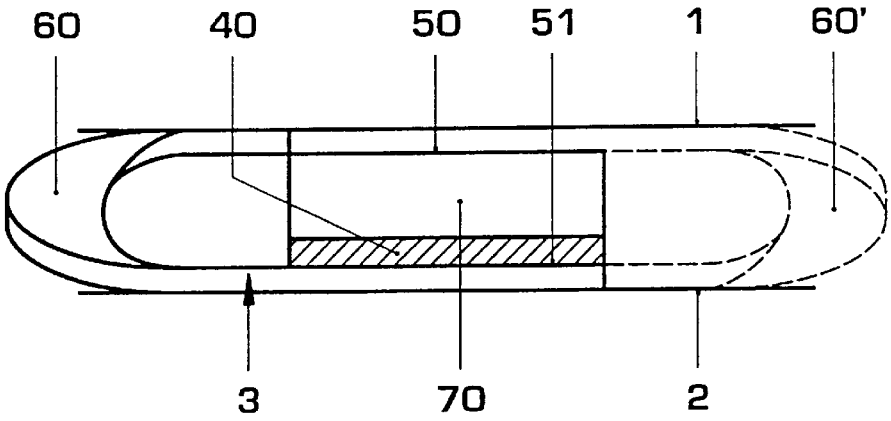

The resistance body 3 can be designed as follows:
as a U with a bent (FIGS. 1 to 5) or straight joining section, as a double U with bent joining sections (FIG. 2 with dashed portion) or straight joining sections, as a helix (FIG. 10), as a double or multiple helix (FIG. 10 with dashed portion), as a meander (FIGS. 3 to 5), as a double meander (FIGS. 6 and 11) or a garland or double garland (stacking of a plurality of body elements designed in accordance with the body element according to FIG. 10 one above the other).

If the resistance body is designed as a double U, double helix, double meander or double garland, then it can have, as well as the response point 60, an additional response point 60' connected in parallel therewith (FIGS. 2, 6, 10 and 11). A resistor provided with such a resistance body 3 is distinguished by high strength, a greater current-carrying capacity and ease of production. At the same time, thermal and mechanical forces occurring during the PTC transition are distributed uniformly in the entire resistor.

If that part containing the response point 60 or those parts containing the response points 60, 60', 61, . . . of the U or of the double U has or have a bent profile as in the case of the embodiments according to FIGS. 1 to 6, then mechanical force produced during the implementation of the PTC transition due to severe local heating of the resistance body in the region of the response points is transmitted in weakened form, on account of the spring action of the limbs of the U or of the double U, to that part of the resistance body which contains the varistors. If the response points are routed into predominantly horizontally routed regions of the joining parts of the U or double U, then virtually no counterforce, which weakens the vertically acting contact force of the resistor, is produced.

If a part of the U or double U which contains a response point 60 runs perpendicularly to the limbs of the U or double U (FIG. 11), then the resistor can be designed in a particularly space-saving manner.

If the resistance body 3 is designed as a helix, garland or double or multiple garland, particularly good cooling of the resistor is achieved since ambient air is then guided along the helical structured resistance body 3 into the interior of the resistor. At the same time, the response points 60, 60' are shaped into a predominantly horizontally routed part of the resistance body. Mechanical force produced during the implementation of the PTC transition due to severe local heating of the resistance body in the region of the response points then acts predominantly in the horizontal direction, with the result that no counterforce, which weakens the vertically acting contact force of the resistor is produced.

The resistance body may also have different yet topologically similar forms which are matched, if appropriate, to the topology of the varistor or of the varistors. The varistor may assume virtually any cross-sectional forms and have, for example, a round, rectangular or oval design.

Figure 12:
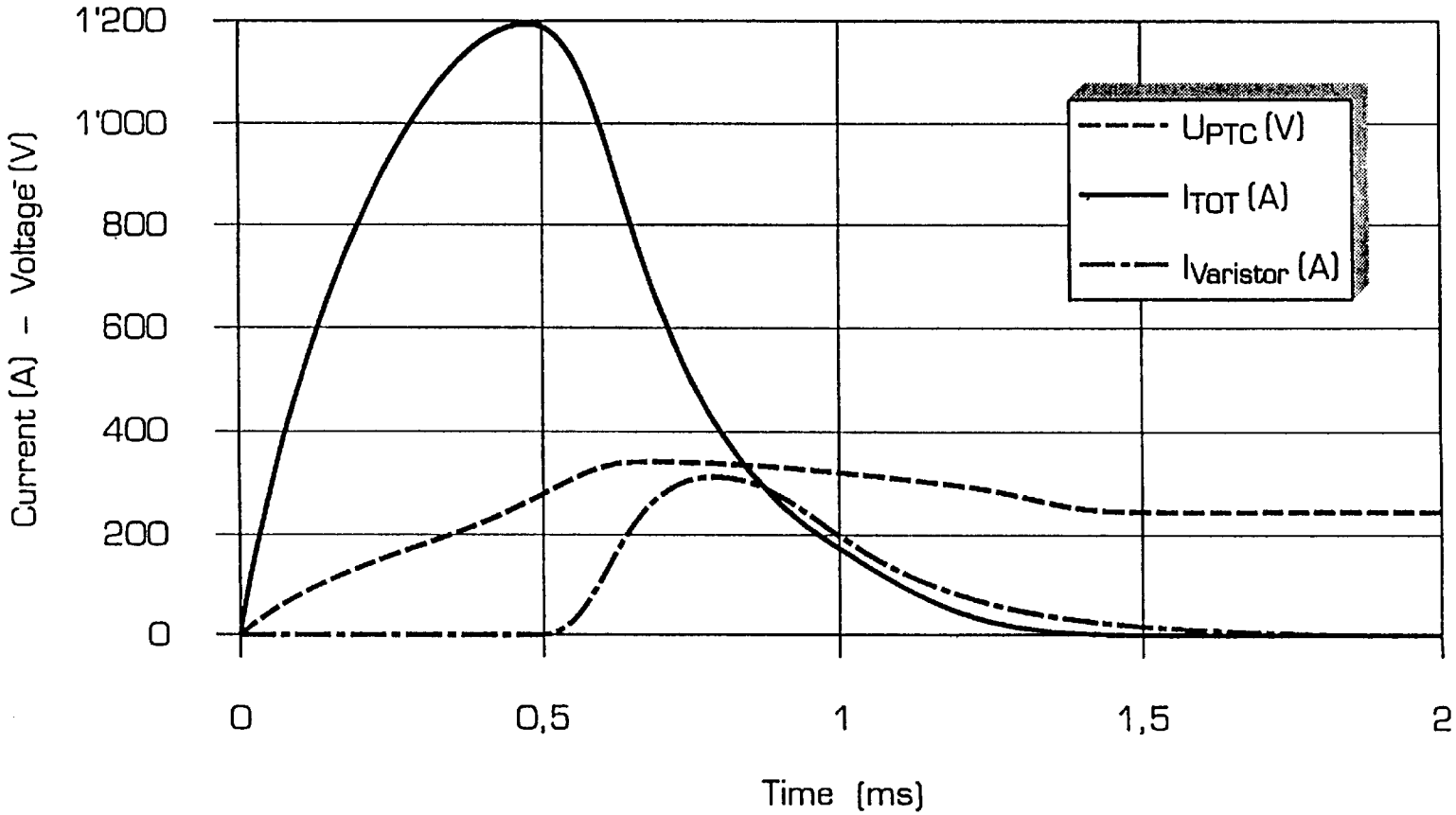
FIG. 12 shows a diagram illustrating the time characteristic of electrical variables which are typical of the behavior of the resistor embodied in accordance with FIG. 2 during the limiting of a short-circuit current, such as the voltage UPTC present across the resistance body as well as the current $I_{PTC}$ conducted in the resistance body and the current $I_{Varistor}$ conducted in the varistor.

The method of operation of a resistor designed according to the invention can be gathered from FIG. 12. This resistor is designed in accordance with the embodiment according to FIG. 2. The U shape of the resistance body 3 was produced by hot bending a plate made of PTC material and having dimensions of 90 mm×40 mm×1.5 mm around a bar having a thickness of 6 mm. The bent resistance body 3 had a constant cross-section over the entire U and had a non-reactive resistance of 160 mΩ. In a load circuit, a prospective short-circuit current of 12 kA was fed to the resistor. This current was clearly limited to a current peak of 1.2 kA and was already less than 200 A after 1 ms. The resistor was able to hold the recovery voltage for at least 100 ms, that is to say over 5 periods, without difficulty. With a correspondingly designed resistor, but in which the bend had a reduced cross-section on account of through holes or a material constriction, the current peak was even limited to 1 kA. However, the non-reactive resistance of this element was, with 250 mΩ, somewhat larger.

Obviously, numerous modifications and variations of the present invention are possible in the light of the above teachings. It is therefore to be understood that within the scope of the appended claims, the invention may be practiced otherwise than specifically described herein.

What is claimed as new and desired to be secured by Letters Patent of the United States is:

1. A current-limiting resistor having two connection electrodes which are arranged parallel to one another, having a resistance body which has PTC behavior and with which large-area contact is made by the connection electrodes, and having a first varistor which is in electrically conductive contact with the resistance body, wherein the resistance body contains two first contact areas as well as a first response point which is spatially separated from the first varistor and which is connected in parallel with the first varistor via the two first contact areas and implements a PTC transition above a threshold value of a current flowing through the resistor.

2. The resistor as claimed in claim 1, having at least one second varistor which can be connected in series with the first varistor, wherein the resistance body contains two second contact areas and at least one second response point which is connected in parallel with the second varistor via the two second contact areas and implements the PTC transition above the threshold value.

3. The resistor as claimed in claim 1, wherein one of the two first contact areas is connected to a contact area of the first varistor via an electrically conductive first intermediate piece.

4. The resistor as claimed in claim 2, wherein a cross-sectional area of the resistance body in at least one of the first and second response points is less than a cross-sectional area of each of the two contact areas between the resistance body and the two connection electrodes.

5. The resistor as claimed in claim 2, wherein sections of the resistance body which are routed parallel to the connection electrodes each contain one of the two first or second contact areas, and wherein at least one of the first and at least a second response point is shaped into a part of the resistance body which connects two of such sections that are adjacent.

6. The resistor as claimed in claim 5, wherein at least one of said first and second response points contain slots, which are routed in the direction of the section ends and are arranged essentially parallel to one another or to a necking.

7. The resistor as claimed in claim 1, wherein the resistance body is of an integral design.

8. The resistor as claimed in claim 1, wherein the resistance body is constructed from a plurality of body elements each having two sections running parallel to the connection electrodes and at least one part which connects the two sections.

9. The resistor as claimed in claim 8, wherein, between the two sections of at least one body element, one of the varistors and at most one section of an adjacent body element in the resistance body are arranged.

10. The resistor as claimed in claim 9, wherein, between the two sections of at least one of the body elements, one of the varistors and one section each of two adjacent body elements in the resistance body are arranged.

11. The resistor as claimed in claim 10, wherein mutually facing faces of the two sections of the body elements are beveled in a wedge-shaped manner.

12. The resistor as claimed in claim 1, wherein the resistance body is shaped as one of a U, a helix, a double U, a double helix, a multiple helix , a meander, a garland, a double meander, a multiple meander, a double garland and a multiple garland.

13. The resistor as claimed in claim 12, wherein, when the resistance body is shaped as one of a double U, a double helix, a double meander or a double garland, there is provided, in addition to the first or second response point, at least one additional response point which is spatially separated from the first varistor and which is connected in parallel therewith.

14. The resistor as claimed in claim 12, wherein every part of the U or double U which contains a response point runs perpendicularly to the limbs of the U or double U.

15. The resistor as claimed in claim 12, wherein every part of the U or double U or multiple U which contains a response point has a bent profile.

* * * * *